US008951170B1

(12) United States Patent
Tayo

(10) Patent No.: US 8,951,170 B1
(45) Date of Patent: Feb. 10, 2015

(54) BAR BELL HAVING A PLURALITY OF DIFFERENTLY ORIENTED HAND GRIPS INTEGRATED THEREIN

(76) Inventor: Abolade N. Tayo, Chicago, IL (US)

( * ) Notice: Subject to any disclaimer, the term of this patent is extended or adjusted under 35 U.S.C. 154(b) by 478 days.

(21) Appl. No.: 13/305,785

(22) Filed: Nov. 29, 2011

(51) Int. Cl.
*A63B 21/072* (2006.01)
*A63B 21/075* (2006.01)
*A63B 71/00* (2006.01)

(52) U.S. Cl.
USPC ..... 482/107; 482/139

(58) Field of Classification Search
USPC ..... 482/93–94, 97–98, 104, 106–108, 139
See application file for complete search history.

(56) References Cited

U.S. PATENT DOCUMENTS

| | | | | |
|---|---|---|---|---|
| 2,508,567 | A | 6/1948 | Dymeck | |
| 4,585,229 | A * | 4/1986 | Brasher | 482/106 |
| 4,768,780 | A * | 9/1988 | Hayes | 482/108 |
| 4,787,629 | A * | 11/1988 | DeMyer | 482/107 |
| 4,822,035 | A | 4/1989 | Jennings et al. | |
| D535,336 | S | 1/2007 | Diakonov et al. | |
| 7,244,220 | B2 | 7/2007 | Carney | |
| 7,381,167 | B2 | 6/2008 | Duhamel | |
| 2003/0130096 | A1 | 7/2003 | LaCroce | |
| 2008/0176723 | A1 | 7/2008 | Johnson | |
| 2009/0247376 | A1 * | 10/2009 | Merrithew et al. | 482/121 |

* cited by examiner

*Primary Examiner* — Loan H Thanh
*Assistant Examiner* — Jennifer M Deichl

(57) ABSTRACT

The bar bell having a plurality of differently oriented hand grips integrated therein is composed of two generally parallel members defining a horizontal axis and in between a plurality of hand grips are provided at varying angles along a vertical axis. The hand grips can be used to conduct weight-lifting exercises involving multiple symmetrical and asymmetrical gripping patterns thereby forming different weight-lifting techniques and exercises. The two generally parallel members include protruding members extending from the respective distal end on which weights may be added and locked in place via a screw lock. The two generally parallel members may include a track therein so as to enable movement of the hand grips along the horizontal axis.

3 Claims, 3 Drawing Sheets

BAR BELL HAVING A PLURALITY OF DIFFERENTLY ORIENTED HAND GRIPS INTEGRATED THEREIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. FIELD OF THE INVENTION

The present invention relates to the field of bar bells and exercise equipment, more specifically, a barbell that includes a plurality of different hand grips at varying orientations, and which maybe capable of translational movement therein.

B. DISCUSSION OF THE PRIOR ART

As will be discussed immediately below, no prior art discloses a barbell that includes a plurality of hand grips each of which are oriented at varying angles along a vertical axis and which provides a plurality of hand grip located along a horizontal axis; wherein the barbell includes two generally parallel members that support the hand grips there between and form the horizontal axis; wherein the plurality of hand grips offer multiple symmetrical and asymmetrical gripping patterns; wherein the plurality of hand grips may be slidelably engaged along a track integrated into the design of the generally parallel members of the barbell so as to enable customization of the location and angle of the handgrips for individual exercises.

The Johnson Patent Application Publication (U.S. Pub. No. 2008/0176723) discloses a curling bar having dynamically rotating grips. However, the dynamically rotating grips do not extend or retract along a horizontal axis either in a fixed location barbell or a barbell that includes a plurality of handgrips that can slide along a track integrated into the design of the curling bar.

The Carney Patent (U.S. Patent No. 7,244,220) discloses an exercise device comprising a weight bearing bar having handles that are perpendicular to the bar providing alternate gripping posture for alternate exercise paradigms. However, the exercise device is not a curling bar or barbell in which a plurality of hand grips are oriented at varying angles and are either positioned at fixed locations or slideably engaged upon a track integrated therein.

The Duhamel Patent (U.S. Patent No. 7,381,167) discloses a dumbbell having a bar disposed at an angle. However, the dumbbell provides a single handle location, and is not capable of providing multiple hand grip locations at a plurality of angles thereon.

The LaCroce Patent Application Publication (U.S. Pub. No. 2003/0130096) discloses a barbell comprising plural handles oriented at selected angles. However, the barbell includes handles capable of rotating about a horizontal axis and do not provide varying angles along a vertical axis while providing multiple hand grip locations along the horizontal axis.

The Jennings et al. Patent (U.S. Patent No. 4,822,035) discloses an adjustable barbell with handles that can be rotated to a position more comfortable to the user's arms for performing various exercises. However, the adjustable barbell features only two hand grips and not a plurality of hand grips that are individually specific to an angle along a vertical axis thereby offering multiple symmetrical as well as asymmetrical gripping patterns.

The Dymeck Patent (U.S. Patent No. 2,508,567) discloses a bar bell with gripping sections disposed at different angles. However, the barbell does not feature two generally parallel members that support multiple hand grips there between and at a plurality of locations thereby offering both symmetrical and asymmetrical gripping patterns.

The Diakonov et al. Patent (U.S. Patent No. Des. 535,336) illustrates a design for an exercise bar, which does not depict two generally parallel members defining a horizontal axis into which a plurality of hand grips are either fixed or slideably engaged there between and of which are locked in at varying angles along a vertical axis.

The Multi Grip Bar, a non-patent piece of prior art located at www.power-systems.com, discloses a weight-lifting bar having a plurality of hand grips at fixed locations and orientations. However, the weight-lifting bar does not offer a track in which the hand grips may slide therein in order to further customize the locations and angles of the hand grips forming either symmetrical or asymmetrical gripping patterns.

While the above-described devices fulfill their respective and particular objects and requirements, they do not describe a barbell that includes a plurality of hand grips each of which are oriented at varying angles along a vertical axis and which provides a plurality of hand grip located along a horizontal axis; wherein the barbell includes two generally parallel members that support the hand grips there between and form the horizontal axis; wherein the plurality of hand grips offer multiple symmetrical and asymmetrical gripping patterns; wherein the plurality of hand grips may be slideably engaged along a track integrated into the design of the generally parallel members of the barbell so as to enable customization of the location and angle of the hand grips for individual exercises. In this regard, the bar bell having a plurality of differently oriented hand grips integrated therein departs from the conventional concepts and designs of the prior art.

SUMMARY OF THE INVENTION

The bar bell having a plurality of differently oriented hand grips integrated therein is composed of two generally parallel members defining a horizontal axis and in between a plurality of hand grips are provided at varying angles along a vertical axis. The hand grips can be used to conduct weight-lifting exercises involving multiple symmetrical and asymmetrical gripping patterns thereby forming different weight-lifting techniques and exercises. The two generally parallel members include protruding members extending from the respective distal end on which weights may be added and locked in place via a screw lock. The two generally parallel members may include a track therein so as to enable movement of the hand grips along the horizontal axis.

An object of the invention is to provide a barbell in which a plurality of hand grips are provided along a horizontal axis, and wherein the hand grips are oriented at a plurality of angles along a vertical axis thereby forming a plurality of symmetrical and as symmetrical gripping patterns.

A further object of the invention is to provide a barbell constructed of two generally parallel members that contain the plurality of hand grips there between.

A further object of the invention is to provide a protruding member at each distal end of the barbell in order to add weights thereon.

A further object of the invention is to provide a track integrated into the design of the two generally parallel members such that the hand grips may slide along the horizontal axis in order to create more gripping locations therein.

These together with additional objects, features and advantages of the bar bell having a plurality of differently oriented hand grips integrated therein will be readily apparent to those of ordinary skill in the art upon reading the following detailed description of presently preferred, but nonetheless illustrative, embodiments of the bar bell having a plurality of differently oriented hand grips integrated therein when taken in conjunction with the accompanying drawings.

In this respect, before explaining the current embodiments of the bar bell having a plurality of differently oriented hand grips integrated therein in detail, it is to be understood that the bar bell having a plurality of differently oriented hand grips integrated therein is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bar bell having a plurality of differently oriented hand grips integrated therein.

It is therefore important that the claims be regarded as including such equivalent construction insofar as they do not depart from the spirit and scope of the bar bell having a plurality of differently oriented hand grips integrated therein. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
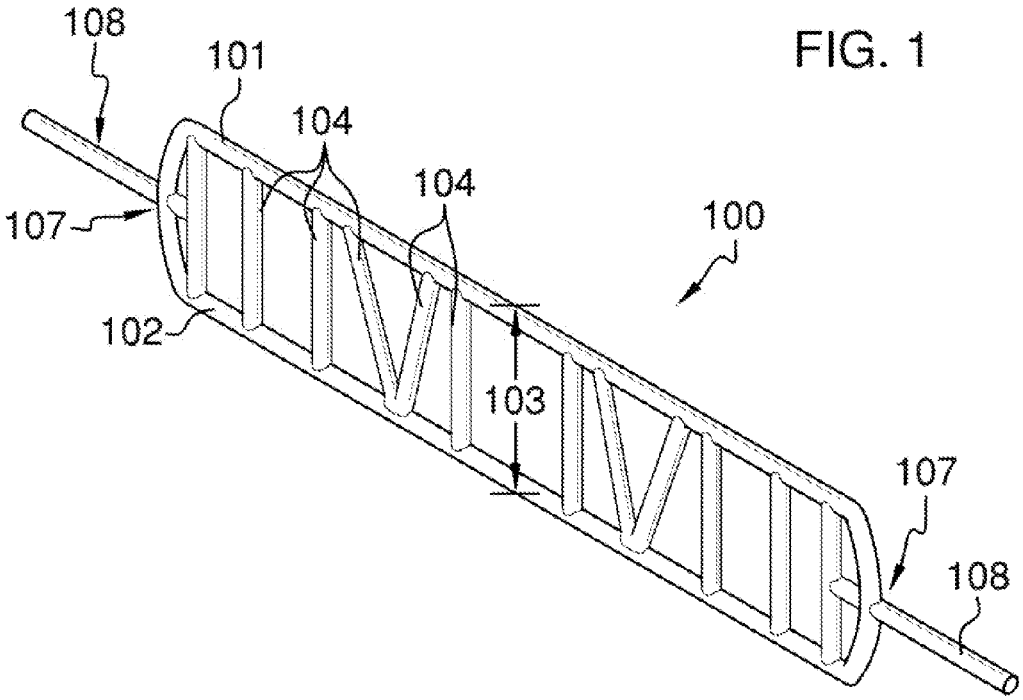
FIG. 1 illustrates a perspective view of the barbell by itself in which the plurality of hand grips are locked in varying locations along the horizontal axis formed via the two generally parallel members.
Figure 2:
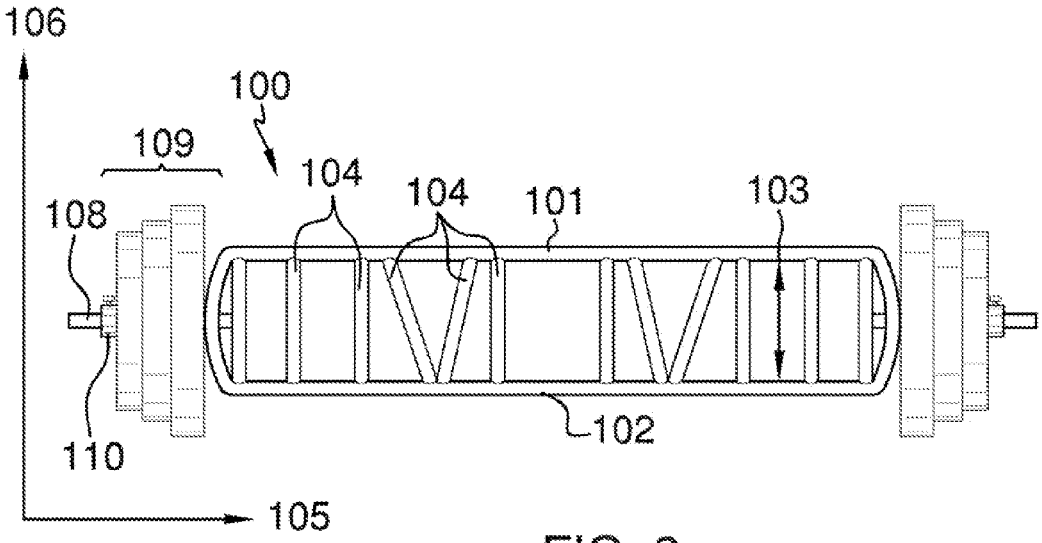
FIG. 2 illustrates a front view of the barbell in which weights are added onto opposing protruding members and further defining the angles formed by the hand grips with respect to the vertical axis.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A bar bell having a plurality of differently oriented hand grips integrated therein 100 (hereinafter invention) includes two generally parallel members 101 and 102. The generally parallel members 101 and 102 are separated by a distance 103 thereby forming an area into which a plurality of hand grips 104 are located. The hand grips 104 are separated from one another along a horizontal axis 105 formed by the invention 100. The hand grips 104 are oriented at a plurality of angles with respect to a vertical axis 106.

Extending from distal ends 107 of the invention 100 are protruding members 108. The distal ends 107 are further defined with a curved member that interconnects the generally parallel members 101 and 102, and which forms an oblong circular shape to the invention 100. The protruding members 108 extend a length 108A, and upon which weights 109 may be added thereon. Locking means 110 may be used to secure the weights 109 onto the protruding members 108.

Figure 3:
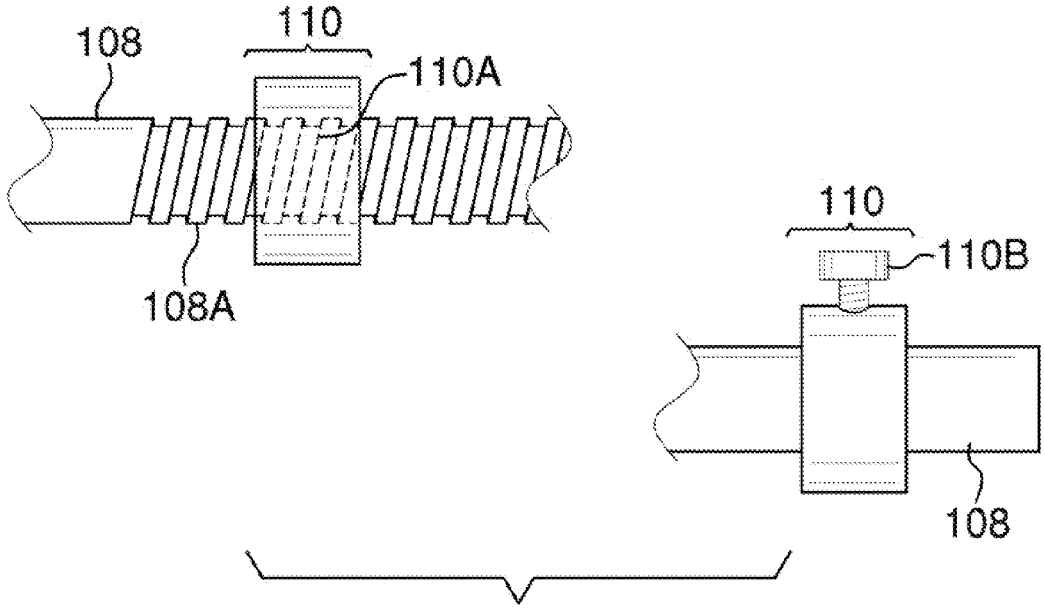
FIG. 3 illustrates a detail of two means by which a lock may be attached onto the protruding members in order to secure weights thereon.

Referring to FIG. 3, the locking means 110 may include a threaded end 108A of the protruding member 108 onto which a threaded lock 110A may screw on, and thereby secure the weights 110 to the invention 100. Alternatively, the locking means 110 may include a set screw 110B that simply secures the locking means 110 onto the protruding member 108.

Figure 4:
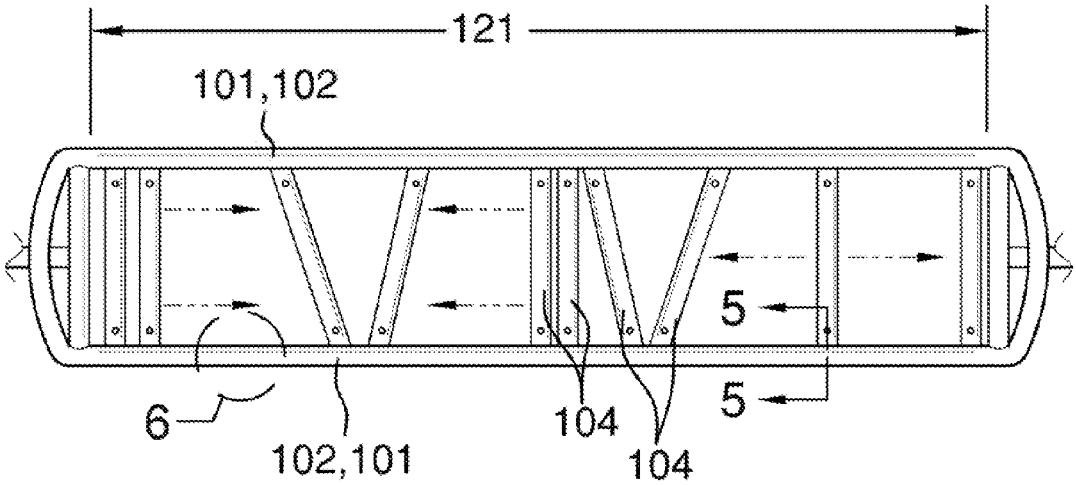
FIG. 4 illustrates a front view of the barbell by itself in which the generally parallel members each include a track that enables lateral movement along the horizontal axis as indicated by the arrows therein.
Figure 5:
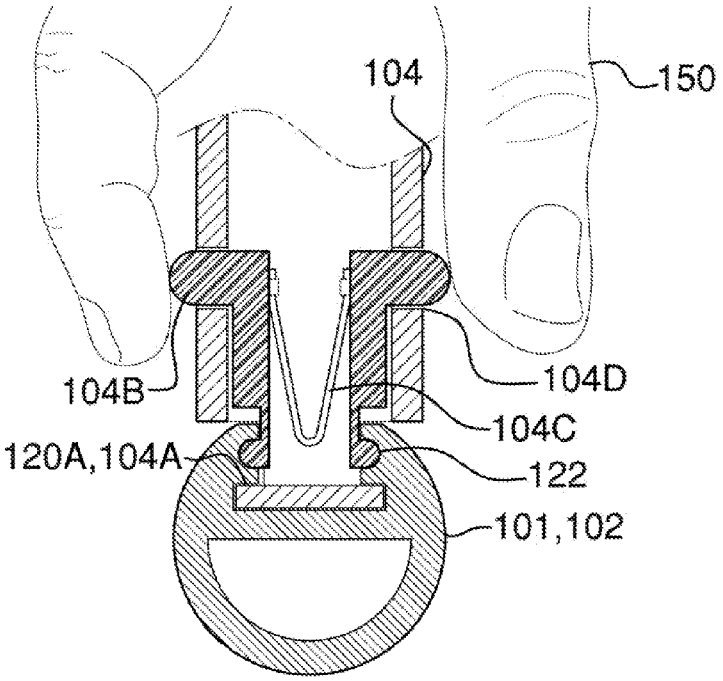
FIG. 5 illustrates a cross-sectional view of the barbell along line 5-5 in FIG. 4, and detailing the track and spring-loaded buttons integrated on each end of each hand grip thereby enabling lateral movement and locking in multiple places along the track.
Figure 6:
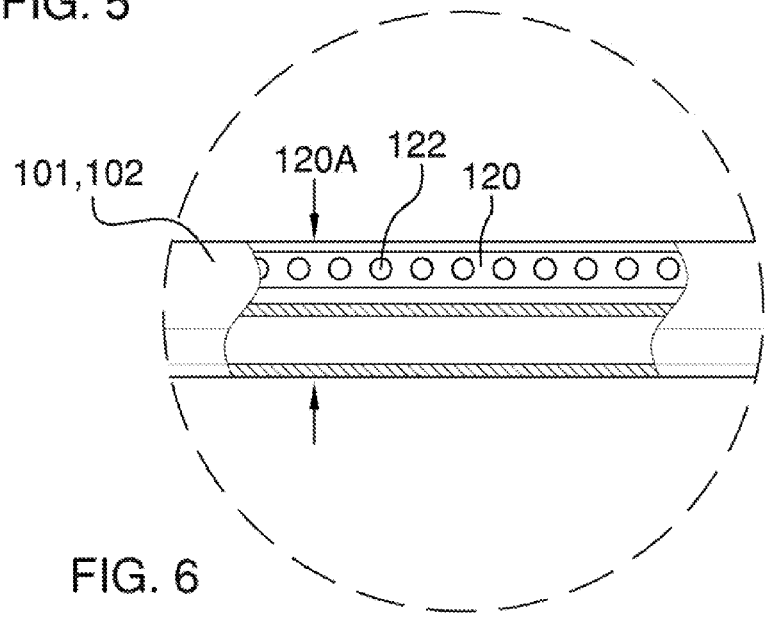
FIG. 6 illustrates a detail of FIG. 4 in which a plurality of holes are depicted along the track of the two generally parallel members in which the spring-loaded buttons shall engage in order to secure the respective hand grip at the respective location along said track.

Referring to FIGS. 4-6, an alternative embodiment of the invention 100 includes a track system that is integrated into the design of the generally parallel members 101 and 102 as well as onto each end of each hang grip 104. More particularly, the generally parallel members 101 and 102 each include a track 120 spanning along a length 121 of the invention 100 (see FIG. 4). Each track 120 includes a plurality of holes 122 therein (see FIG. 6).

Referring to FIG. 5, the track 120 has a grooved notch 120A along which each end of each hand grip 104 slides thereon. That being said, the hand grips 104 each include a shoulder 104A that mirrors the shape of the grooved notch 120A. Moreover, the hand grips 104 include on each end, a spring-loaded button 104B that includes a spring 104C therein. The spring-loaded button 104B can engage and disengage from one of the holes 122 along the track 120. Each end of each hand grip 104 includes holes 104D that correspond with the spring-loaded button 104B, and which enable opposing fingers 150 of an end user to squeeze the spring-loaded button 104B inwardly thereby disengaging the spring-loaded button 104B with respect to the holes 122 along the track 120. The track 120 and spring-loaded button 104B configuration enables the hand grips 104 to be adjusted along the horizontal axis 105 while maintaining the angles formed with respect to the vertical axis 106.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A bar bell having a plurality of differently oriented hand grips integrated therein comprising:

two generally parallel members that are separated by a distance and located in between is a plurality of hand grips;

wherein the plurality of hand grips are oriented at a plurality of angles with respect to a vertical axis; whereas the hand grips are positioned at varying locations along a horizontal axis;

wherein protruding members extend from distal ends of said barbell and upon which weights are added and secured via locking means;

wherein the distal ends include a curved member forming an oblong circular shape with respect to the generally parallel members;

wherein the locking means attach to the protruding members via a threaded lock that screws onto a threaded end provided along the protruding members;

wherein the locking means includes a set screw that secures the locking means onto the protruding member;

wherein the generally parallel members each include a track along a length in which each end of each hand grip shall engage and slide along;

wherein the track includes a grooved notch whereas each end of each hand grip includes a shoulder mirroring the grooved notch.

2. The bar bell having a plurality of differently oriented hand grips integrated therein as described in claim 1 wherein the track includes a plurality of holes equally spaced along said length.

3. The bar bell having a plurality of differently oriented hand grips integrated therein as described in claim 2 wherein each end of the hand grips includes a spring-loaded button that engages or disengages one of the holes of said track thereby locking into place along the length of the generally parallel members.

* * * * *